United States Patent [19]

Nakajima

[11] Patent Number: 4,691,750

[45] Date of Patent: Sep. 8, 1987

[54] BARKING MACHINE

[75] Inventor: Junichi Nakajima, Shizuoka, Japan

[73] Assignee: Fuji Kogyo Kabushiki Kaisha, Shizuoka, Japan

[21] Appl. No.: 889,923

[22] Filed: Jul. 25, 1986

[30] Foreign Application Priority Data

Dec. 25, 1985 [JP] Japan ..... 60-296587

[51] Int. Cl.[4] ..... B27C 9/00

[52] U.S. Cl. ..... 144/208 B; 144/341

[58] Field of Search ..... 144/208 R, 208 B, 341

[56] References Cited

U.S. PATENT DOCUMENTS

| | | | |
|---|---|---|---|
| 1,966,153 | 7/1934 | Thorne | 144/208 B |
| 2,647,548 | 8/1953 | Guettler | 144/208 B |
| 3,866,639 | 2/1975 | Kantola et al. | 144/208 B |

*Primary Examiner*—W. D. Bray

*Attorney, Agent, or Firm*—Browdy and Neimark

[57] ABSTRACT

A barking machine has a container for processing logs formed with openings each extended lengthwise of the container, a transfer guide plate disposed between the openings, multiple notches formed in the openings, lower and side cylindrical rotators each having protruding barking blades on its outer periphery which pass through the notches, and a supporting member for retaining the transfer guide plate. In such a construction, the rotors are partially inserted into the openings, respectively. The lower rotor rotates so that its barking blades move toward the side opening, and the side rotor rotates so that its blades move upwardly. With this arrangement, it is possible to prevent the logs from being blocked between the rotators or falling from therebetween, and to provide a strengthened transfer guide plate with no deformation, thereby enhancing the circulating of logs in the container and the barking operation.

8 Claims, 9 Drawing Figures

BARKING MACHINE

FIELD OF THE INVENTION

The present invention relates to a barking machine for barking logs for pulp.

BACKGROUND OF THE INVENTION

Conventional barking machines are known wherein cylinders of the machine are provided with a plurality of protruding barking blades, on the outer peripheries thereof. These cylinders are partially inserted into an opening formed in the lower portion of a container for processing logs. On the side wall of the container a plurality of slits each extending vertically, and a plurality of disc barking blades are inserted into the slits, said disc blades being supported by a shaft which is arranged outside of the container.

Other barking machines are known wherein the lower portion of a container is opened, the upper portions of a plurality of cylindrical rotors disposed in parallel with each other are inserted in the openings, and a plurality of protruding barking blades are provided on the outer peripheries of the cylinders. For a more detailed description of this machine, see U.S. application Ser. No. 675,871.

The prior art barking machines, however, include a number of disadvantages. In the prior art machines, logs are put into a container, where they are placed at one end side portion thereof. While the logs are stripped of their bark, they are consecutively moved to the other end side portion. The ends of the logs impinge upon the disc blades to render transmission impossible. Additionally, the relatively short logs intersect the lengthwise direction of the container, in which state the logs are caught in a space formed by the disc blades and the side wall of the container. Blockage of the logs is produced by a bridge-spanned configuration created in the container.

These containers have been made wider in order to enhance their processing capability. However, this structure encourages the logs to be brought down crosswise, so that the above-described blockage occurs often.

The disc blades rotate while retaining the bark or the wooden segments by their side plane, which are transferred from one side to the other side in the container in such a way that they circulate and rotate, pursuing the logs. The bark or the wooden segments are interposed between the disc blades and long stitches through which the disc blades are inserted into the container, thereby creating a blockage.

The barking machine disclosed in the specification of U.S. patent application Ser. No. 675,871, however, creates other disadvantages wherein the protruding barking blades provided on the outer peripheries of the cylinders must be higher, in order that the log is shifted from one lower side of the container to the other lower side thereof while being rotated, and at the same time is returned to the one side by being pushed up. Even if rotational loci of the barking blades of the adjacent cylinders are located proximate each other to prevent the log from falling between these cylinders, the logs having small diameters are either dropped from therebetween or are sandwiched therebetween.

SUMMARY OF THE INVENTION

Accordingly, it is a primary object of the present invention to obviate the above-described defects of the prior art machines.

The barking machine of the present invention has a plurality of longitudinal openings sectioned by transfer guide plates. These openings are formed in the lower and side portions of the container of the machine. A plurality of notches through which pass a plurality of barking blades are formed in both lengthwise sides of the respective openings. Cylindrical rotors are disposed at the lower and side portions of the container, and are partially inserted from the outside into each of the openings. The rotors include a plurality of protruding barking blades on their outer peripheries. The lower rotor is made to rotate so that its barking blades move toward the side opening, while the side rotor is rotated so that its barking blades move upward. The bark on logs fed at the end portion of the container is peeled off by means of the lower rotor, and the logs are simultaneously transferred from one side to the other side and lifted along the transfer guide plate. This transfer guide plate provided between the foregoing openings is mounted on a supporting member in the machine frame. The side rotor takes over the thus lifted logs with the aid of its outer peripheral surface, and the barking blades effect additional barking processing. The thus processed logs are then pushed out so as to be circulated within the container. Thereafter, the logs descend from one side, undergo the barking processing by the lower rotor, and are finally transferred to the other side. The end portion of the logs impinges upon the circumferential surface of the side rotor, even if the thus circulated log assumes a slant posture, thereby making the logs move smoothly. The peeled bark or the segments of the log are positively thrown out with the aid of the barking blades so that the bark or the segments are directed to notches formed in the side edges of the transfer guide plate. The transfer guide plate is formed with multiple notches in either edge to prevent a log of small diameter from being blocked between the cylinders or falling therebetween, thus promoting the circulation of the logs.

According to the present invention, each log fed from one end portion of the container is barked by means of the barking blades provided on the outer periphery of the lower rotor while being retained by this rotor. The log is then moved to the other side so as to be lifted along the transfer guide plate, and is further lifted with the aid of the barking blades which are projected on the outer periphery of the side rotor. The log is finally pushed out toward one side, whereby the log is subjected to reprocessing over the circulation.

During the thus-repeated barking process, the log is shifted to a discharge port for discharge therefrom. Even though the log assumes an oblique posture as it circulates within the container, its end portion abuts the circumferential surface of the side rotor, and hence there is no possibility for the log to be kept from moving to the discharge port, or to cause any blockage. Moreover, the stripped pieces of bark are seized by the barking blades and thrown out from the notches in such a state that they are retained on the circumferential surfaces of the rotors.

As in the case with log having a small diameter, the transfer guide plate is capable of securely guiding even heavy logs having a large diameter from the lower rotor to the upper rotor, without causing any deformation when the barking machine is large in size and increases in length.

DESCRIPTION OF THE DRAWINGS

The FIGS. in combination show one embodiment of the present invention.

FIGS. 58(*a*), 5(*b*) are sectional views showing a side rotor and a bearing portion, respectively;

DETAILED DESCRIPTION OF THE PREFERRED EMBODIMENT

Figure 1:
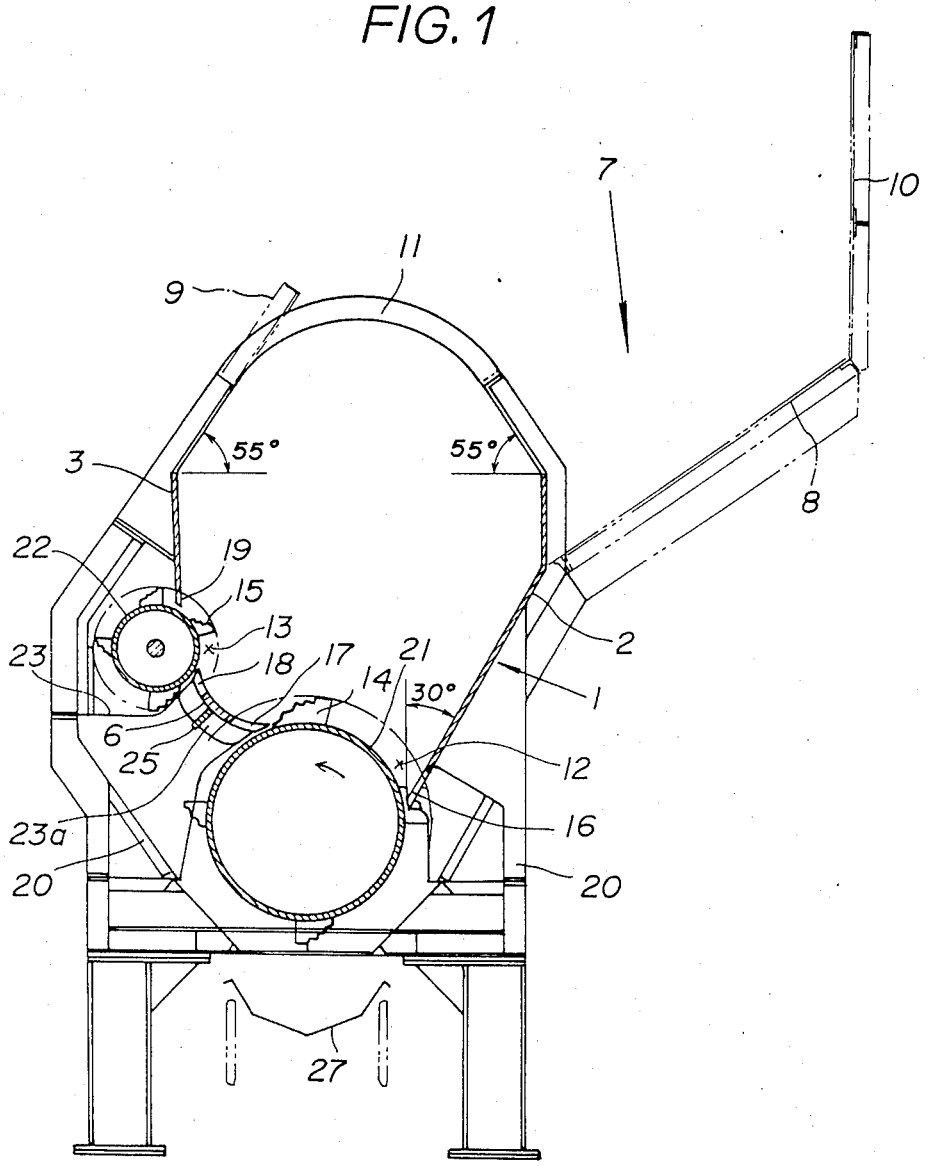
FIG. 1 is a cross-sectional view showing a barking machine.
Figure 2:
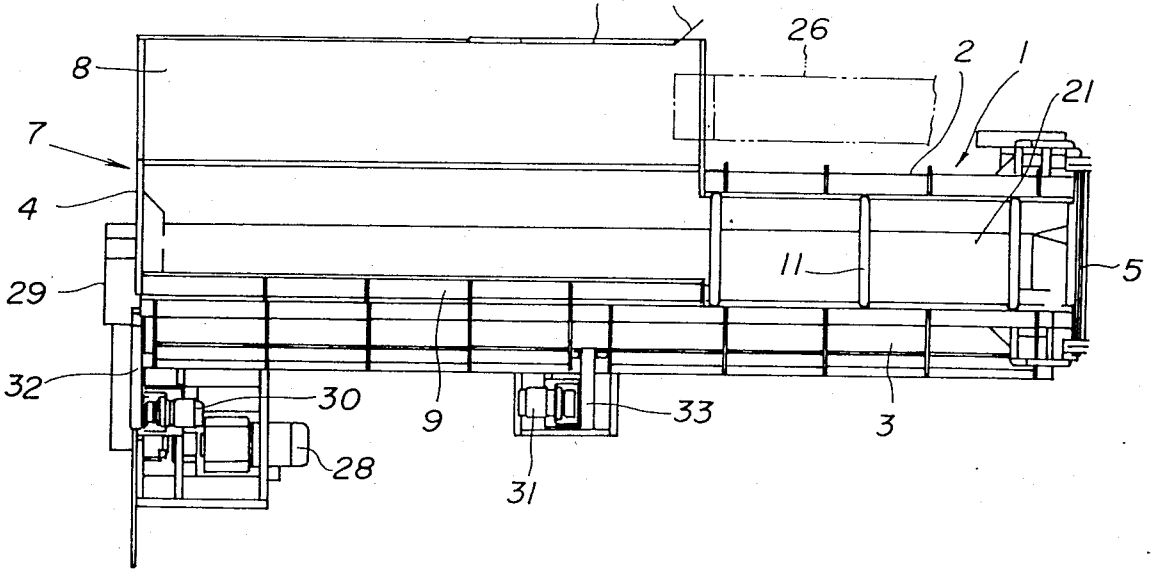
FIG. 2 is a plan view thereof.
Figure 3:
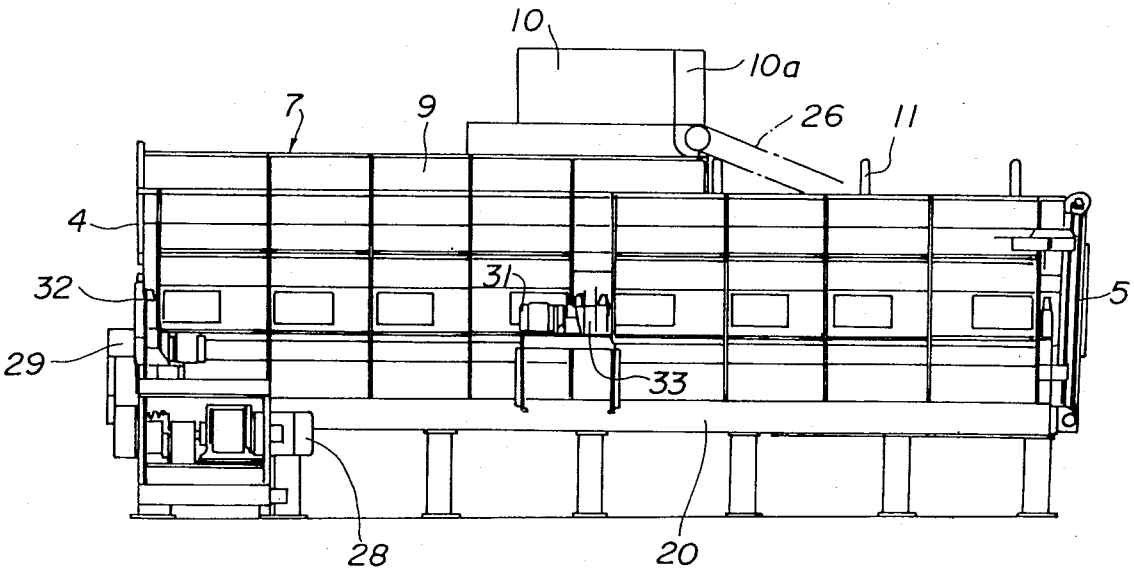
FIG. 3 is a side view thereof.
Figure 4:
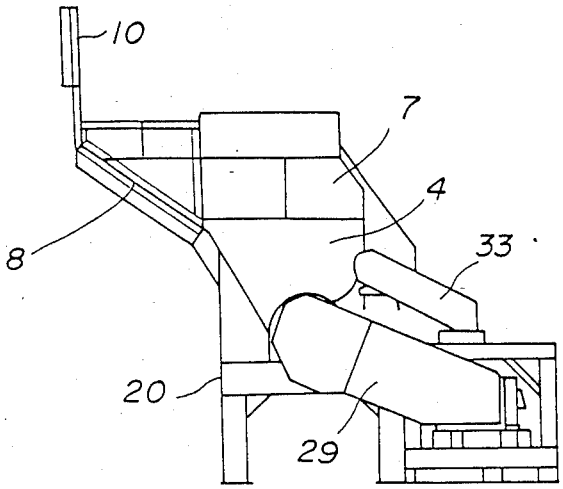
FIG. 4 is a front view thereof.
Figure 5B:
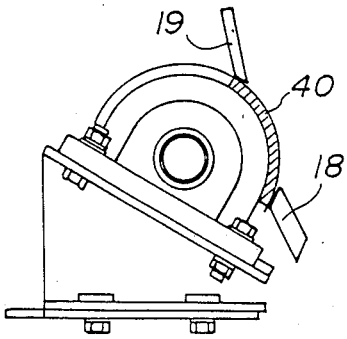
Figure 5A:
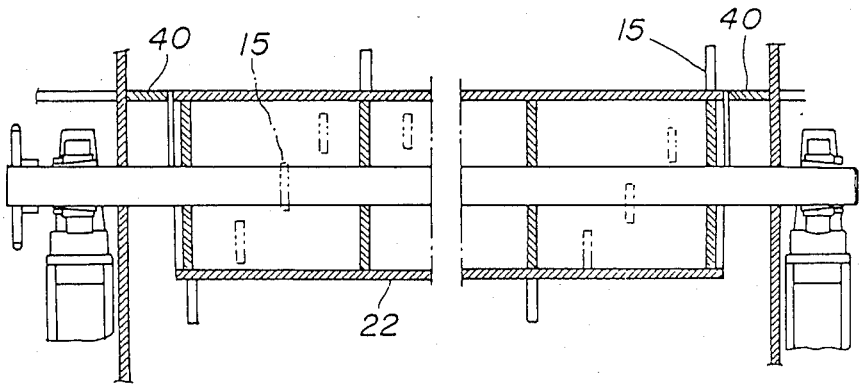

One embodiment according to the present invention will hereinafter be described with reference to the accompanying drawings. A container 1 consists of right and left side plates 2, 3, an end plate 4 provided on the feed-in side, a plate 5 provided on the outlet side which includes a movable shutter and a crooked transfer guide plate 6. The outlet side lower and upper portions of the side plate 2 are slanted inwards, and the feed-in portion of the side plate 2 is obliquely projected and is also directed upwards and outwards so as to form a guide plate 8 of a hopper 7. The upper portion of the other side plate 3 is slanted to the inside; and at the position corresponding to the hopper 7 is provided a guide plate 9, the configuration being such that the guide plate 9 is so extended as to be oblique to the same degree or arranged more slantwise or rendered in a downward circular arc. On the outlet side of the upper end of the guide plate 8, there is vertically provided an attachable and detachable receiving plate 10 which includes a guide portion 10*a* that looks oblique if viewed on the plane. In the case where the logs are short, the logs are fed from the end plate 4 provided on the feed-in side instead of from the receiving plate 10; whereas if the logs are long, the receiving plate 10 is removed.

The upper portions of the right and left side plates 2, 3 are linked at plural points by means of circular arc linking members 11, these upper portions being so disposed as to be remote from the hopper 7.

A lower opening 12 is formed between the lower edge of the transfer guide plate 6 and the lower end of the side plate 2; and a side opening 13 is formed between the upper edge of the transfer guide plate 6 and the lower edge of the other side plate 3. On both sides of the openings 12, 13 are formed comb notches 16, 17, 18 and 19 for the barking blades 14, 15 which will be mentioned later.

The outer periphery of a lower cylindrical rotor 21 which is journalled in a machine frame 20 is spirally equipped with a multiplicity of protruding barking blades 14 each having a height corresponding to the size of the log, the blades gradually stepwise increasing in height towards the rear portion of the rotary direction; the upper portions thereof are inserted in the lower opening 12 in order to form the bottom of the container 1. A side rotor 22 which is journalled at an upper position outside the foregoing transfer guide plate 6 is formed with a plurality of barking blades 15 spirally projected on its outer periphery, these blades 15 being the same as the above-described barking teeth 14 or slightly lower than the teeth 14. Part of the side rotor 22 is arranged to be inserted through the side opening 13 into the container 1.

Figure 6:
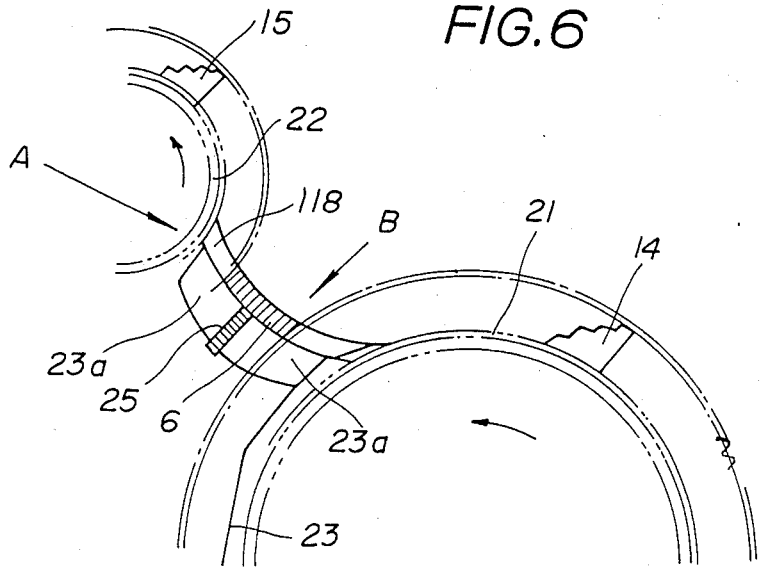
FIG. 6 is a cross-sectional view showing a transfer guide plate installing portion.
Figure 7:
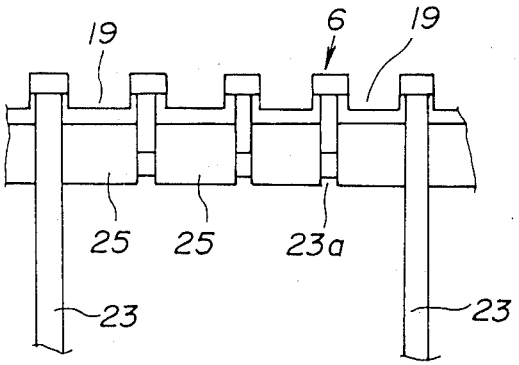
FIG. 7 is a view in the direction of the arrow A in FIG. 6.
Figure 8:
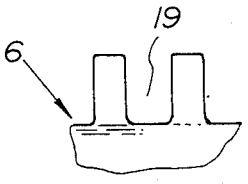
FIG. 8 is a view in the direction of the arrow B in FIG. 6.

Both ends of the transfer guide plate 6 are welded to the machine frame 20. A lateral frame 23 includes its plate which is perpendicular to the lower rotor 21 and to the side rotor 22, this lateral frame plate 23 taking such a configuration that it becomes wider like a trapezoid as it diverges toward the lower portion thereof. Where this kind of plate 23 is large in size, the top portion thereof is welded at proper spacings which are set, for instance, by ten notches 17 or 18 to the intermediate portion of the transfer guide plate 6. These welding portions are the lower surfaces of the protrusions provided between the notches 17, 18 of the transfer guide plate 6. Between the lateral frame plates 23, plates 23*a*, each having a small width are, as shown in FIGS. 6, 7, welded respectively or spaced to the lower surfaces of the protrusions of the transfer guide plate 6. The upper surfaces of the plates 23*a* are welded to the widthwise intermediate portion of the transfer guide plate 6; the end portions thereof are welded to the machine frame 20, the lateral frame plates 23 and the plates 23*a* thereby to integrally secure a lengthwise frame plate 25.

The reference numeral 26 stands for a return conveyor and the numeral 27 denotes a discharge conveyor.

In the above-described barking machine, the lower rotor 21 is driven by a transmission gear 29 by a motor 28; the side rotor 22 is driven by proper transmission gears 32, 33 by means of motors 30, 31, these rotors respectively rotating in the counterclockwise direction (however, a peripheral speed of the side rotor 22 is equal to or exceeds that of the lower rotor). A plurality of logs are fed in by the use of a feed conveyor or a lifter and are then transferred from one side to the other side, pushing the log which is at the front position of the rotational direction in such a state that the fed-in log is retained by the lower rotor 21. In the meantime, the log is barked. Thereafter, the thus barked log is so lifted along the transfer guide plate 6 in order that the side rotor 22 takes over the log. The log is further barked by the barking blades 15 of the side rotor 22 and is at the same time subjected to a push-up operation and a push-out operation. In the wake of this, the log descends to the side plate 2 in a circular manner to undergo additional barking processing.

During such barking processing, the logs take various postures—some become slant. However, even if the end of the wood impinges upon the circumferential surface of the side rotor 22, this log is pushed by other logs, or it is guided by its own weight toward the circumferential surface, at which time the log freely slides thereon and no blockage is created thereby. Consequently, the log smoothly moves to the outlet or of the spiral arrangement of the barking blades 14, 15.

In such a case, the stripped bark or the segments of the log are seized and are then securely discharged out by the barking teeth 14, 15 which intermittently pass through the notches 17 formed in the side edges of the transfer guide plate 6 and through the comb like notches 19 formed in the lower portion of the container 1. A plurality of cylindrical lower and side rotors 21, 22 are juxtaposed. Nevertheless, the transfer guide plate 6 prevents a log having a small diameter from being sandwiched between the lower rotor 21 and the side rotor 22, or from falling from therebetween.

Moreover, the side rotor 22 is also formed with a multiplicity of relatively high barking blades 15 on its peripheral surface and hence it is feasible to obtain highly effective barking and circulative operations. However, the side rotor 22 must be equipped with a multiplicity of barking blades 15. This leads to an arrangement wherein the transfer guide plate 6 is likewise formed with a multiplicity of notches 17, 18 on either side thereof, whereby the transfer guide plate 6 becomes fragile.

For the purpose of eliminating this kind of fragility, the transfer guide plate is rendered large in width. Consequently, the circulating and barking operations of the log decrease in efficiency, which results in the fact that the side rotor 22 is likely to separate from the lower rotor 21. Inasmuch as the present invention, however, employs a supporting member, even through attempting to enhance the circulative operation and the barking operation as well by shrinking the width of the transfer guide plate 6, the plate 6 is by no means deformed by the weight of the log. Furthermore, there is no possibility to cause impingement upon the rotors 21, 22 and to decrease the efficiency in transfer guide operation. If the supporting member is constituted as described in the embodiment, is is feasible to strengthen the degree to which the transfer guide plate 6 is supported all the more.

The foregoing description of the specific embodiment(s) will so fully reveal the general nature of the invention that others can, by applying current knowledge, readily modify and/or adapt for various applications such specific embodiment(s) without departing from the generic concept, and, therefore, such adaptations and modifications should and are intended to be comprehended within the meaning and range of equivalents of the disclosed embodiment(s). It is to be understood that the phraseology or terminology employed herein is for the purpose of description and not of limitation.

What is claimed is:

1. A barking machine for removing bark from logs, comprising a container for receiving said logs to be debarked, having a lengthwise opening formed a lower portion and at a side portion thereof, a transfer guide plate disposed in said opening, a plurality of notches formed on both lengthwise sides of said opening, a cylindrical lower rotor and a side rotor, each said rotor having a plurality of protruding barking blades which pass through said notches, said rotors being partially inserted from the outside of said container into said opening on opposite sides of said transfer guide plate, said lower rotor being rotated so that its barking blades move said logs toward said transfer guide plate, and said side rotor being rotated so that said barking blades move upwardly.

2. The barking machine of claim 1 wherein said transfer guide plate is supported by a supporting member in a machine frame.

3. The barking machine of claim 1 wherein said supporting member assumes a configuration such that a plate surface thereof is constituted by integrally fixing a lateral frame parallel with said notches and a lengthwise frame parallel with said transfer guide plate.

4. The barking machine of claim 2 wherein said supporting member assumes a configuration such that a plate surface thereof is constituted by integrally fixing a lateral frame parallel with said notches and a lengthwise frame parallel with said transfer guide plate.

5. The barking machine of claim 1 wherein said transfer guide plate is curved inwardly to form a concavity.

6. The barking machine of claim 2 wherein said transfer guide plate is curved inwardly to form a concavity.

7. The barking machine of claim 3 wherein said transfer guide plate is curved inwardly to form a concavity.

8. The barking machine of claim 4 wherein said transfer guide plate is curved inwardly to form a concavity.

* * * * *

US004691750B1

REEXAMINATION CERTIFICATE (3032th)

United States Patent [19]

Nakajima

[11] B1 4,691,750

[45] Certificate Issued Oct. 29, 1996

[54] BARKING MACHINE

[75] Inventor: Junichi Nakajima, Shizuoka, Japan

[73] Assignee: Fuji Kogyo Kabushiki Kaisha, Fujieda, Japan

Reexamination Request:
No. 90/003,633, Nov. 14, 1994

Reexamination Certificate for:

| | |
|---|---|
| Patent No.: | **4,691,750** |
| Issued: | **Sep. 8, 1987** |
| Appl. No.: | **889,923** |
| Filed: | **Jul. 25, 1986** |

[30] Foreign Application Priority Data

Dec. 25, 1985 [JP] Japan ..... 60-296587

[51] Int. Cl.[6] ..... B27C 9/00

[52] U.S. Cl. ..... 144/208.9; 144/341

[58] Field of Search ..... 144/208.1, 208.9, 144/340, 341

[56] References Cited

U.S. PATENT DOCUMENTS

| | | | |
|---|---|---|---|
| 1,966,153 | 7/1934 | Thorne | 144/208.9 |
| 2,647,548 | 8/1953 | Guettler | 144/208.9 |
| 3,866,639 | 2/1975 | Kantola et al. | 144/208.9 |

FOREIGN PATENT DOCUMENTS

| | | |
|---|---|---|
| 5914323 | 10/1980 | Japan . |
| 56-98112 | 8/1981 | Japan . |
| 60-23961 | 1/1984 | Japan . |
| 331564 | 1/1984 | Japan . |
| 6250283 | 11/1984 | Japan . |
| 61-16088 | 1/1985 | Japan . |
| 60-23003 | 2/1985 | Japan . |
| 63205 | 8/1985 | Japan . |
| 60-125103 | 8/1985 | Japan . |
| 329122 | 5/1986 | Japan . |

OTHER PUBLICATIONS

CKS Brochure, "Long Barker Series" (Jan. 1985).

*Primary Examiner*—W. Donald Bray

[57] ABSTRACT

A barking machine has a container for processing logs formed with openings each extended lengthwise of the container, a transfer guide plate disposed between the openings, multiple notches formed in the openings, lower and side cylindrical rotators each having protruding barking blades on its outer periphery which pass through the notches, and a supporting member for retaining the transfer guide plate. In such a construction, the rotors are partially inserted into the openings, respectively. The lower rotor rotates so that its barking blades move toward the side opening, and the side rotor rotates so that its blades move upwardly. With this arrangement, it is possible to prevent the logs from being blocked between the rotators or falling from therebetween, and to provide a strengthened transfer guide plate with no deformation, thereby enhancing the circulating of logs in the container and the barking operation.

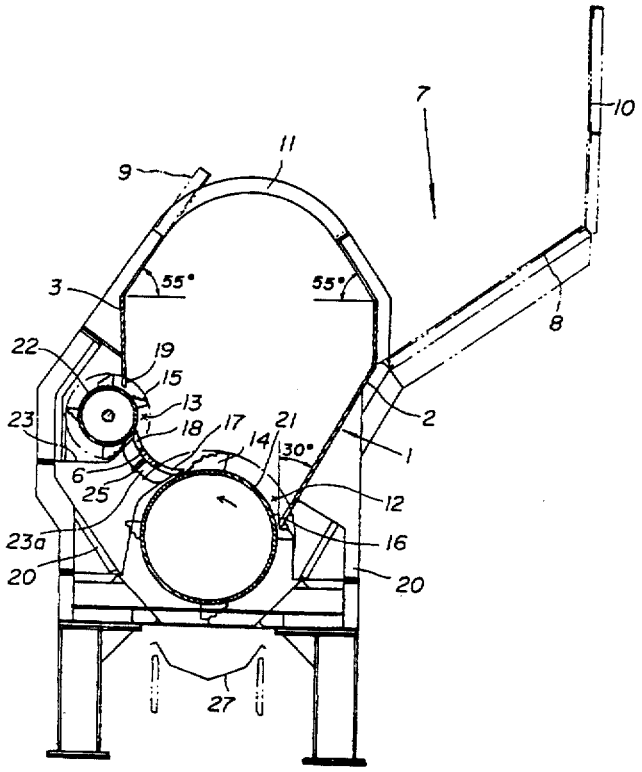

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 12–13:

FIGS. [58(a)] *5(a)*, 5(b) are sectional views showing a side rotor and a bearing portion, respectively;

Column 3, line 59 to column 4, line 6:

The outer periphery of a lower cylindrical rotor 21 which is journalled in a machine frame 20 is spirally equipped with a multiplicity of protruding barking blades 14 each having a height corresponding to the size of the log, the blades gradually stepwise increasing in height towards the rear portion of the rotary direction; the upper portions thereof are inserted in the lower opening 12 in order to form the bottom of the container 1. A side rotor 22 which is journalled at an upper position outside the foregoing transfer guide plate 6 is formed with a plurality of barking blades 15 spirally projected on its outer periphery, these blades 15 being the same as the above-described barking [teeth] *blade* 14 or slightly lower than the [teeth] *blade* 14. Part of the side rotor 22 is arranged to be inserted through the side opening 13 into the container 1.

Column 4, lines 51–59:

During such barking processing, the logs take various postures—some become slant. However, even if the end of the wood impinges upon the circumferential surface of the side rotor 22, this log is pushed by other logs, or it is guided by its own weight toward the circumferential surface, at which time the log freely slides thereon and no blockage is created thereby. Consequently, the log smoothly moves to the outlet [or] of the spiral arrangement of the barking blades 14, 15.

AS A RESULT OF REEXAMINATION, IT HAS BEEN DETERMINED THAT:

Claims 2, 3 and 7 are cancelled.

Claims 1, 4 and 6 are determined to be patentable as amended.

Claims 5 and 8, dependent on an amended claim, are determined to be patentable.

New claims 9, 10 and 11 are added and determined to be patentable.

1. A barking machine for removing bark from logs, comprising a container for receiving said logs to be debarked, having a lengthwise opening *a width of which is* formed *from*

*said lengthwise opening continuously extending from a log-infeeding side of said container to a log-outfeeding side thereof,* a transfer guide plate disposed in said opening *and having lengthwise sides extending from said log-infeeding side to said log-outfeeding side,* a plurality of notches formed on both lengthwise sides of said opening *and said lengthwise sides of said transfer guide plate,* a cylindrical lower rotor [and a side rotor, each said rotor] having *a circumferential surface which extends from said log-infeeding side to said log-outfeeding side and has* a plurality of protruding barking blades [which pass through said notches,] *formed thereon,*

*a cylindrical side rotor extending along said lower rotor, and having a circumferential surface which continuously extends from said log-infeeding side to said log-outfeeding side and has a plurality of barking blades formed thereon,* said [rotors] *lower rotor and said side rotor* being partially inserted from the outside of said container into said opening on opposite sides of said transfer guide plate, *a longitudinal portion of said circumferential surface of said side rotor continuously projecting into said container through said opening from said log-infeeding side to said log-outfeeding side,*

*said respective barking blades of said lower rotor and said side rotor passing through corresponding said notches,* said lower rotor being rotated so that its barking blades move said logs toward said transfer guide plate, and said side rotor being rotated so that said barking blades move upwardly

*wherein rotation of said side rotor within said container precludes jamming of the logs between the plurality of barking blades on said side rotor.*

4. The barking machine of claim [2] *9*, wherein said supporting [member] *means* assumes a configuration such that a plate surface thereof is constituted by integrally fixing a lateral frame parallel with said notches and a lengthwise frame parallel with said transfer guide plate.

6. The barking machine of claim [2] *9* wherein said transfer guide plate is curved inwardly to form a concavity.

*9. The barking machine according to claim 1 wherein,*

*said transfer guide plate is spaced apart from said lower rotor and said side rotor, and*

*said machine further comprises support means for supporting said transfer guide plate spaced apart from said lower rotor and said side rotor.*

*10. A barking machine for removing bark from logs, comprising*

*a container for receiving said logs to be debarked, having a lengthwise opening formed at a lower portion and a side portion thereof,*

*a transfer guide plate disposed in said opening,*

*a plurality of notches formed on both lengthwise sides of said opening,*

*a cylindrical lower rotor and a side rotor, each said rotor having a plurality of protruding barking blades which pass through said notches, said rotors being partially inserted from the outside of said container into said opening on opposite sides of said transfer guide plate,*

*said lower rotor being rotated so that its barking blades*

*said side rotor being rotated so that said barking blades move upwardly,*

*said transfer guide plate being supported by a supporting member in a machine frame, and*

*said supporting member assuming a configuration such that a plate surface thereof is constituted by integrally fixing a lateral frame parallel with said notches and a*

*lengthwise frame parallel with said transfer guide plate.*

*11. The barking machine of claim 10 wherein said transfer guide plate is curved inwardly to form a concavity.*

* * * * *